US006672517B1

(12) United States Patent
Lüscher

(10) Patent No.: US 6,672,517 B1
(45) Date of Patent: Jan. 6, 2004

(54) VALVE FOR FUEL BURNER

(75) Inventor: Michel Lüscher, Breite-Nurensdorf (CH)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/889,988

(22) PCT Filed: Jan. 27, 2000

(86) PCT No.: PCT/EP00/00614

§ 371 (c)(1),
(2), (4) Date: Jul. 20, 2001

(87) PCT Pub. No.: WO00/46549

PCT Pub. Date: Aug. 10, 2000

(30) Foreign Application Priority Data

Feb. 1, 1999 (DE) ..... 199 03 831

(51) Int. Cl.[7] ..... B05B 15/02; B05B 1/28; B05B 9/00; B05B 1/30

(52) U.S. Cl. ..... 239/119; 239/124; 239/104; 239/127; 239/586

(58) Field of Search ..... 239/104, 106, 239/108, 109, 110, 111, 119, 124, 125, 127, 585.1, 586; 251/129.15; 137/65, 565.01, 565.23

(56) References Cited

U.S. PATENT DOCUMENTS

| | | | | |
|---|---|---|---|---|
| 2,468,960 A | | 5/1949 | Case | |
| 3,886,974 A | | 6/1975 | Bjorklund | |
| 3,987,810 A | * | 10/1976 | Bjorklund | 137/107 |
| 4,134,428 A | * | 1/1979 | Bjorklund | 137/882 |
| 4,270,561 A | * | 6/1981 | Bjorklund | 137/107 |
| 4,797,089 A | * | 1/1989 | Schubach et al. | 431/28 |
| 4,877,395 A | * | 10/1989 | Schubach et al. | 431/28 |
| 6,004,127 A | * | 12/1999 | Heimberg et al. | 431/179 |

FOREIGN PATENT DOCUMENTS

| | | |
|---|---|---|
| EP | 0624711 A | 11/1994 |
| EP | 0808795 A | 11/1997 |

* cited by examiner

*Primary Examiner*—Davis Hwu

(57) ABSTRACT

The invention relates to a system made of an oil pump and of a magnet valve for preventing oil from dripping when the oil burner is switched off. The inventive system is provided with an oil pump (23) and a magnet valve (10) which has a closing body (16) that comprises an oil flow borehole (17). The closing body (16) is displaceably located in a borehole (12). An oil line (11) goes through the borehole (12). The oil flow borehole (17) of the closing body (16) complements the oil line (11) in a first position of the inventive magnet valve (10). The oil flow is thus released. The closing body (16) interrupts the oil line (11) in a second position of the magnet valve (10). A vacuum is simultaneously generated in said second position. The vacuum reverses the direction of oil flow in an end section (15) of the oil line (11). The oil is thus prevented from dripping.

19 Claims, 2 Drawing Sheets

VALVE FOR FUEL BURNER

Figure 1:
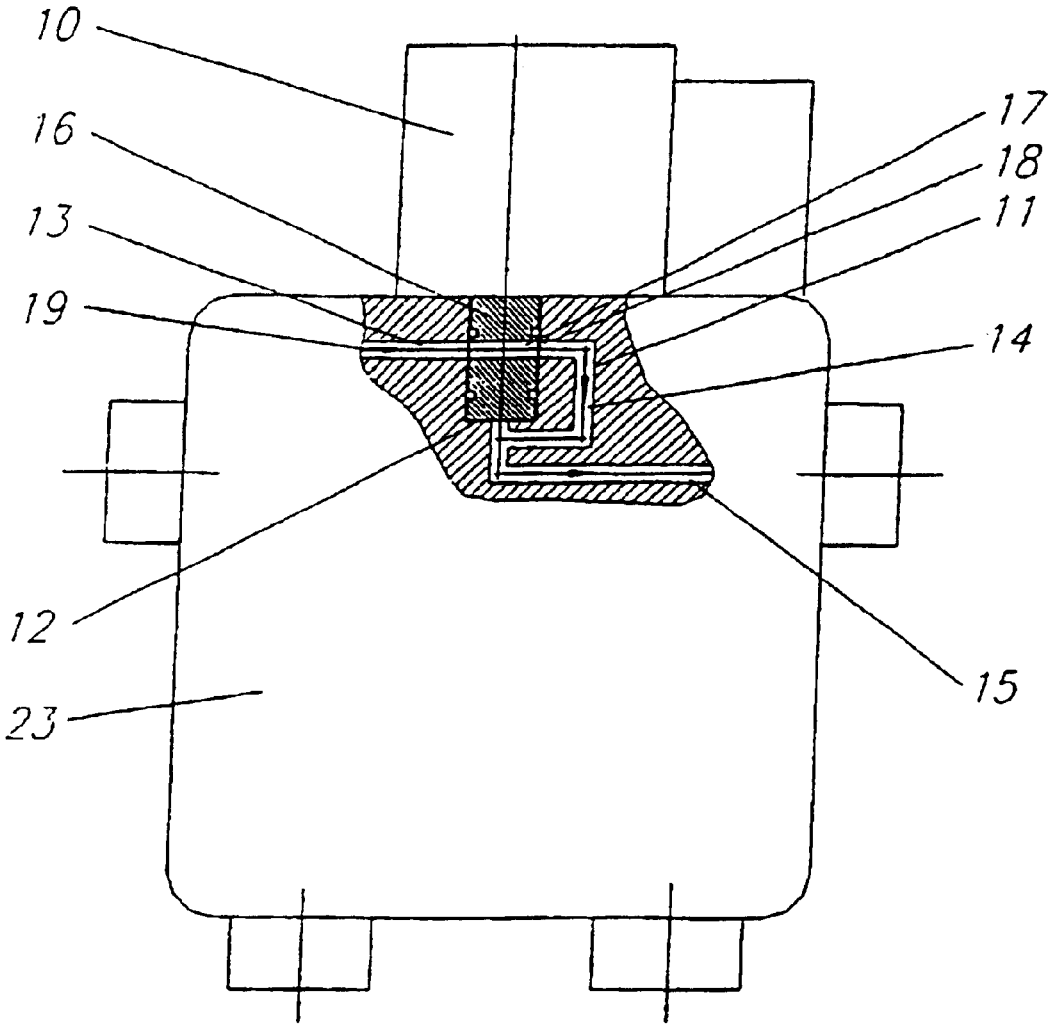

The invention relates to a system including an oil pump and of a valve, in particular a solenoid valve, for oil burners.

In oil burners, the fuel, which is oil, is sucked in from an oil tank with the aid of an oil pump and is fed under pressure to an oil nozzle, as a rule to a pressure atomizer nozzle. At the pressure atomizer nozzle, the fuel, that is to say the oil, is atomized into fine droplets, is mixed with injected air and is burnt in a flame. The flame is ignited by means of a corresponding ignition mechanism. It burns independently and in a stable fashion, as long as combustion air and oil are supplied to a sufficient extent and under appropriate conditions, such as, for example, sufficient pressure and suitable flow conditions.

In pressure atomizer nozzles of this type, dripping of the fuel, which is oil, may commence when the burner is switched off. This oil then collects, unburnt, in a burner space. This is a disadvantage, since, when the burner is restarted, there is in the burner space excess oil which is manifested in the form of unburnt hydrocarbons in the exhaust gas and thus considerably impairs the emission values of the burner. Also, since these unburnt oil residues may contaminate the burner mixing head and the burner space to an extent such that, for example, undesirable soot may be built up and considerable burner disturbances may thereby be caused. Dripping of oil when the burner is switched off must therefore be avoided.

The prior art, such as, for example, U.S. Pat. No. 5,799,871, EP 0 806 246 and EP 0 731 315, discloses various nozzle shut-off valves which are intended to prevent the oil from dripping into the burner space when the oil burner is switched off.

Proceeding from this, the problem on which the present invention is based is to provide a novel system which by simple design means prevents the oil from dripping.

This problem is solved by means of a system having the features of claim 1.

Further advantageous refinements of the invention may be gathered from the subclaims and the description.

Figure 2:
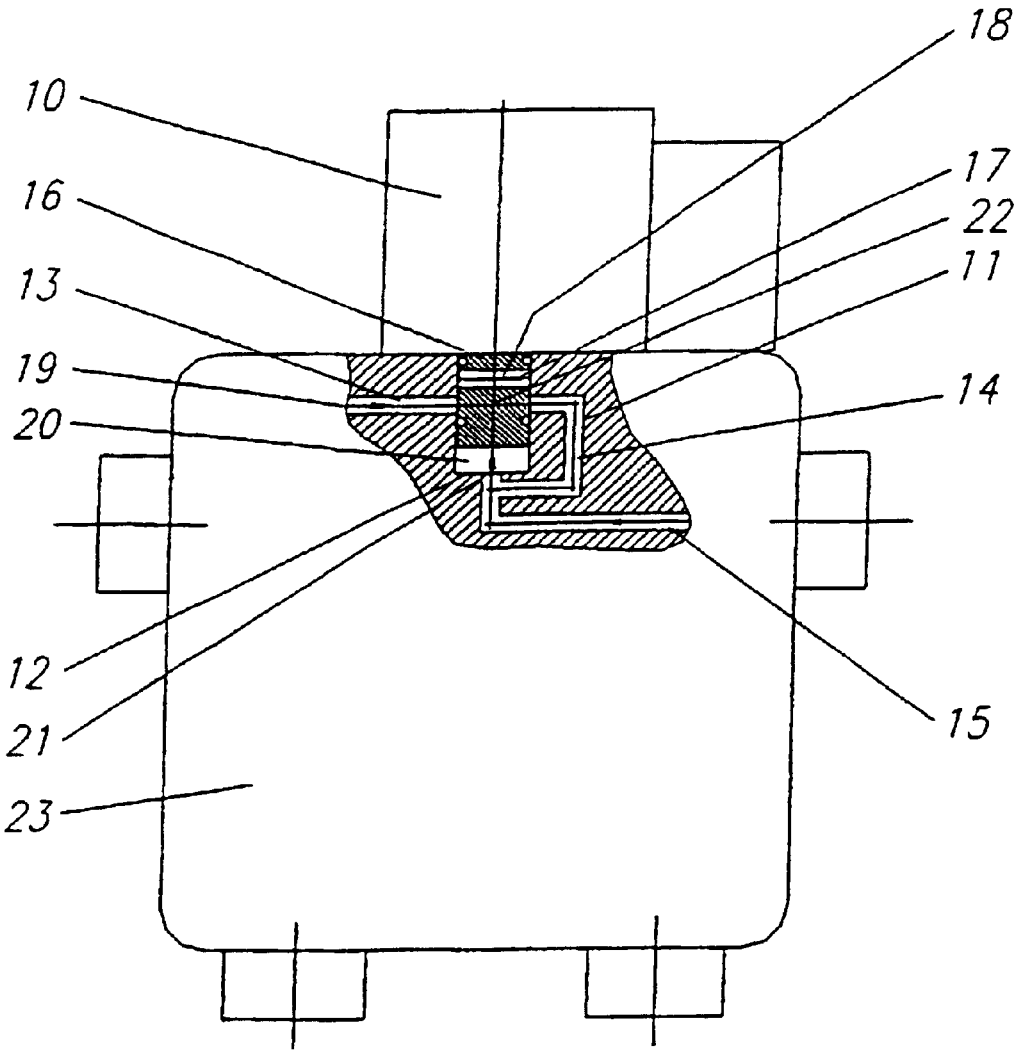

A preferred exemplary embodiment of the invention is explained in more detail below with reference to the drawing in which:

FIG. 1 shows a highly diagrammatic illustration of a system according to the invention including an oil pump and of a valve, to be precise a solenoid valve, in a position releasing an oil flow, and FIG. 2 shows a system according to the invention including the oil pump and of the solenoid valve in a position blocking the oil flow.

The system according to the invention, illustrated in the drawing, by simple design means prevents oil from dripping into a burner space of an oil burner not illustrated in detail.

FIG. 1 shows the system according to the invention in the form of a cutout from an oil pump 23, on which is mounted a valve, to be precise a solenoid valve 10, which is arranged in the region of the inside-pump oil line 11 (also called oil pressure line) which is interrupted by a bore 12. The bore 12 accordingly subdivides the oil line 11 basically into two portions 13 and 14, to be precise into a first portion 13 which runs upstream of the bore 12 in the oil flow direction and into a second portion 14 which is arranged downstream of the bore 12 in the oil flow direction. An end portion 15 of the second portion 14 serves for coupling to the nozzle assembly, not illustrated, having a pressure atomizer nozzle.

A closing body 16 is arranged within the bore 12. The closing body 16 is mounted so as to be axially displaceable within the bore 12.

According to FIGS. 1 and 2, the closing body 16 has an oil passage bore 17. When the closing body 16 is in the position illustrated in FIG. 1, with the valve open, the oil passage bore 17 completes the inside-pump oil line 11 and thus releases the oil flow from the oil tank in the direction of the pressure atomizer nozzle. For this purpose, a center axis 18 of the oil passage bore 17 coincides with a center axis 19 of the oil line 11 in the region of the bore 12. Furthermore, the diameters of the oil passage bore 17 and of the oil line 11 in the region of the bore 12 are adapted to one another, that is to say they correspond to one another.

When the oil burner is to be switched off and the oil flow from the oil tank, not illustrated, in the direction of the pressure atomizer nozzle, likewise not illustrated, is to be interrupted, the closing body 16 of the solenoid valve 10 is displaced axially, to be precise is moved into the position illustrated in FIG. 2. When the closing body 16 is in this second position, the inside-pump oil line 11 is interrupted by the closing body 16. Furthermore, with the closing body 16 in this position, a reception space 20 is provided below the latter, thus resulting, within the portion 14 of the oil line 11 and therefore also within the end portion 15, in a vacuum being generated, as a result of which the direction of the oil flow within the end portion 15 is reversed. In this position, therefore, the oil is drawn away from the pressure atomizer nozzle of the oil burner and is collected in the reception space 20. For this purpose, the bore 12 is connected via a corresponding orifice 21 to the second portion 14 of the oil line 11 and to the end portion 15.

It may also be noted, finally, that, in the exemplary embodiment illustrated in the drawing, the center axis 18 of the oil passage bore 17 runs approximately perpendicularly to a center axis 22 of the closing body 16.

It follows directly from the above description of the system according to the invention that dripping of the oil when the oil burner is switched off is avoided. The system including the oil pump 23 and the solenoid valve 10 has, so to speak, integrated oil return suction. It may be noted, for the sake of completeness, that other valves may also be used instead of a solenoid valve.

LIST OF REFERENCE SYMBOLS

10 Solenoid valve
11 Oil line
12 Bore
13 Portion
14 Portion
15 End portion
16 Closing body
17 Oil passage bore
18 Center axis
19 Center axis
20 Reception space
21 Orifice
22 Center axis
23 Oil pump

What is claimed is:

1. A valve (10) for controlling the flow of a liquid through a delivery line (11), the valve comprising:

a body, the body having bore (12) for receiving a closing body (16), the closing body (16) having a passage bore (17) which selectively passes the liquid from an upstream portion of the delivery line (11) to a downstream portion of the delivery line (11), wherein when the valve (10) is in a first position, a center axis (18) of the passage bore (17) coincides with a center axis (19) of the delivery line (11) at least in the region of the bore (12) such that the passage bore (17) of the closing body (16) completes the delivery line (11) and thus releases flow of the liquid from the upstream portion of the delivery line (11) to the downstream portion of the delivery line (11), and wherein when the valve is in a second position, the closing body (16) interrupts the flow of the liquid from the upstream portion of the delivery line (11) to the downstream portion of the delivery line (11), generates a negative pressure in at least part of the bore (12) which is in fluid communication with at least part of the downstream portion of the delivery line, and thus at least temporarily reverses the flow of the liquid in at least a portion of the downstream portion (15) of the delivery line (11).

2. A valve (10) as claimed in claim 1, characterized in that the closing body (16) is axially displaceable in the bore (12), and in that a center axis (18) of the passage bore (17) runs approximately perpendicularly to a center axis (22) of the closing body (16).

3. A valve (10) as claimed in one or more of claims 1 to 2, characterized in that, when the solenoid valve (10) is in the second position, the closing body (16) is displaced in such a way that a reception space (20) for liquid is obtained within the bore (12).

4. A valve (10) as claimed in claim 3, characterized in that the reception space (20) is in fluid communication with the downstream portion of the delivery line.

5. A valve (10) as claimed in one or more of claim 1, 2, or 4, characterized in that the diameters of the passage bore (17) and of the delivery line (11) correspond to one another at least in the region of the bore (12).

6. A valve as claimed in claim 1 wherein the liquid is a fuel oil.

7. A valve as claimed in claim 6 wherein the valve is in-line with the delivery line, and the delivery line and valve pass the fuel oil from an oil pump to a burner.

8. A valve as claimed in claim 1 wherein the valve (10) is a solenoid controlled valve.

9. A valve (10) for controlling the flow of a liquid through a delivery line (11), the valve comprising:

a body, the body having bore (12) defined by side walls and at least one end wall, the bore (12) receiving a closing body (16), the closing body (16) having a passage (17) which selectively passes the liquid from an upstream portion of the delivery line (11) to a downstream portion of the delivery line (11), wherein when the valve (10) is in a first position, the passage (17) of the closing body (16) completes the delivery line (11) and thus releases a flow of the liquid from the upstream portion of the delivery line (11) to the downstream portion of the delivery line (11), and wherein when the valve is in a second position, the closing body (16) interrupts the flow of the liquid from the upstream portion of the delivery line (11) to the downstream portion of the delivery line (11), and generates a negative pressure in a reception space (20) created in the bore (12) between the closing body (16) and the body, wherein the reception space (10) is in fluid communication with at least part of the downstream portion of the delivery line via an orifice that extends though at least part of the end wall of the bore (12), and thus at least temporarily reverses the flow of the liquid in at least a portion of the downstream portion (15) of the delivery line (11).

10. A valve (10) as claimed in claim 9, characterized in that the closing body (16) is axially displaceable in the bore (12), and the passage (17) extends linearly through the closing body (16) along a center axis (18) that runs approximately perpendicularly to a center axis (22) of the closing body (16).

11. A valve (10) as claimed in claim 10, characterized in that, when the valve (10) is in the first position, the center axis (18) of the passage (17) coincides with a center axis (19) of the delivery line (11) in the region of the bore (12).

12. A valve (10) as claimed in claim 9, characterized in that, when the valve (10) is in the second position, the closing body (16) is displaced away from the end wall of the body to create the reception space (20) between the closing body (16) and the body.

13. A valve (10) as claimed in claim 9, characterized in that the cross-sectional area of the passage (17) and the cross-sectional area of the delivery line (11) correspond to one another at least in the region of the bore (12).

14. A valve as claimed in claim 9 wherein the liquid is a fuel oil.

15. A valve as claimed in claim 14 wherein the valve is in-line with the delivery line, and the delivery line and valve pass the fuel oil from an oil pump to a burner.

16. A valve as claimed in claim 9 wherein the valve (10) is a solenoid controlled valve.

17. A valve (10) for controlling the flow of a liquid through a delivery line (11), the valve comprising:

a body having bore (12), wherein the bore (12) receives a closing body (16), the closing body (16) having a passage bore (17) that extending through the closing body, wherein when the valve (10) is in a first position, the passage (17) of the closing body (16) completes the delivery line (11) and thus releases a flow of the liquid from an upstream portion of the delivery line (11) to a downstream portion of the delivery line (11), and wherein when the valve is in a second position, the closing body (16) interrupts the flow of the liquid from the upstream portion of the delivery line (11) to the downstream portion of the delivery line (11), and generates a negative pressure in a reception space (20) that is in fluid communication with at least part of the downstream portion of the delivery line and thus at least temporarily reverses the flow of the liquid in at least a portion of the downstream portion (15) of the delivery line (11).

18. A system comprising:

an oil pump;

a burner;

a delivery line for delivering fuel oil from the oil pump to the burner;

a valve in line with the delivery line, the valve including:

a body having bore (12), wherein the bore (12) receives a closing body (16), the closing body (16) having a passage bore (17) that extending through the closing body, wherein when the valve (10) is in a first position, the passage (17) of the closing body (16) completes the delivery line (11) and thus releases a flow of the liquid from an upstream portion of the delivery line (11) to a downstream portion of the delivery line (11) and to the burner, and wherein when the valve is in a second position, the closing body (16) interrupts the flow of the liquid from the upstream portion of the delivery line (11) to the downstream portion of the delivery line (11), and generates a negative pressure in a reception space (20) that is in fluid communication with at least part of the downstream portion of the delivery line and thus at least temporarily reverses the flow of the liquid in at least a portion of the downstream portion (15) of the delivery line (11) and away from the burner.

19. A system as claimed in claim 18 wherein the valve (10) is a solenoid controlled valve.

* * * * *